US008013793B2

(12) United States Patent
Hung et al.

(10) Patent No.: US 8,013,793 B2
(45) Date of Patent: Sep. 6, 2011

(54) MULTI-BAND ANTENNA

(75) Inventors: Chen-Ta Hung, Tu-cheng (TW); Yun-Lung Ke, Tu-cheng (TW); Po-Kang Ku, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 384 days.

(21) Appl. No.: 12/291,139

(22) Filed: Nov. 5, 2008

(65) Prior Publication Data

US 2009/0115665 A1 May 7, 2009

(30) Foreign Application Priority Data

Nov. 5, 2007 (TW) ..... 96141630 A

(51) Int. Cl.
*H01Q 1/38* (2006.01)

(52) U.S. Cl. ..... 343/700 MS; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 7,289,071 | B2 | 10/2007 | Hung et al. | |
| 7,498,992 | B2 * | 3/2009 | Hung et al. | 343/702 |
| 7,633,448 | B2 * | 12/2009 | Su et al. | 343/702 |
| 7,746,288 | B2 * | 6/2010 | Wang et al. | 343/846 |
| 2007/0040754 | A1 | 2/2007 | Liu et al. | |
| 2007/0060222 | A1 | 3/2007 | Finn et al. | |
| 2007/0096999 | A1 | 5/2007 | Wang et al. | |

* cited by examiner

*Primary Examiner* — Hoang V Nguyen
(74) *Attorney, Agent, or Firm* — Wei Te Chung; Andrew C. Cheng; Ming Chieh Chang

(57) ABSTRACT

A multi-band antenna, being made from an integrated metal patch, includes a grounding element, a first antenna and a second antenna, both of which are works in wireless local area net, and a third antenna working in wireless wide area net. The first, second, and third antennas extends from the grounding element and substantially along a lengthwise direction.

20 Claims, 5 Drawing Sheets

MULTI-BAND ANTENNA

BACKGROUND OF THE INVENTION

1. Field of the Invention

The present invention relates generally to a multi-band antenna, and more particularly to a multi-band antenna suitable for being built into an electronic device, such as a notebook.

2. Description of the Prior Art

A present electric device always needs more than one type of antennas for wireless communication. To make design of the electric device more beautiful, theses antennas are assembled in the inner space of the electric device. Thus, antennas used on different frequency bands are always integrated together to reduce their volume for the limited inner space.

US Patent Application Publication No. 2007/0040754 discloses an antenna structure integrating a first antenna of wireless wide area network (WWAN) and a second antenna of wireless local area network (WLAN), the same as U.S. Pat. No. 7,289,071, US Patent Application Publication No. 2007/0060222, US Patent Application Publication No. 2007/0096999, and so on. The two antennas respectively work as a single antenna but not influence to each other. However, the antenna structure works under only two wireless communication criterions, which is not fit for three and more wireless communication criterions.

Hence, in this art, a multi-band antenna to overcome the above-mentioned disadvantages of the prior art should be provided.

BRIEF SUMMARY OF THE INVENTION

A primary object, therefore, of the present invention is to provide a multi-band antenna work on three different wireless communication criterions.

In order to implement the above object, the multi-band antenna, being made from an integrated metal patch, comprises a grounding element, a first antenna and a second antenna, both of which work in wireless local area net, and a third antenna working in wireless wide area net. The first, second, and third antennas extends from the grounding element and substantially along a lengthwise direction.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
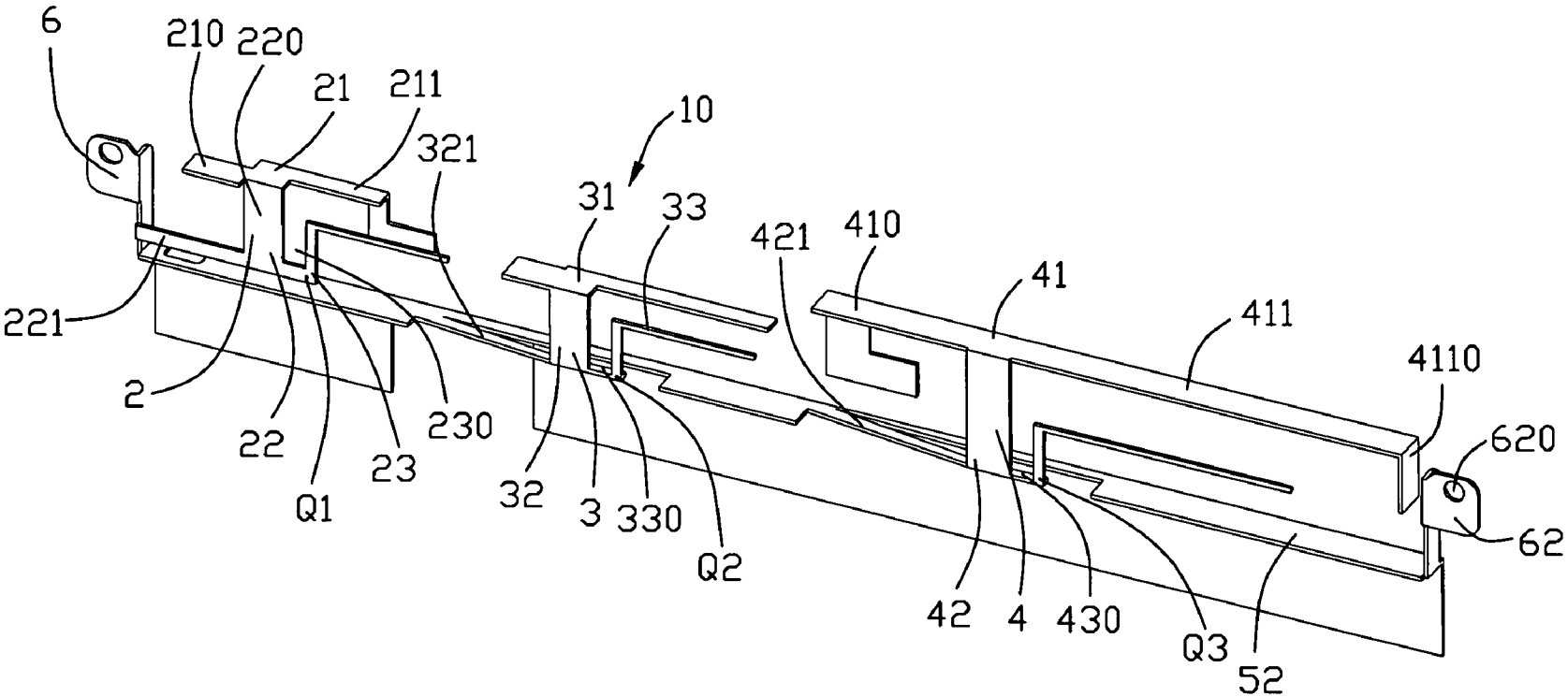
FIG. 1 is a perspective view illustrating a first embodiment of a multi-band antenna in according with the present invention.
Figure 2:
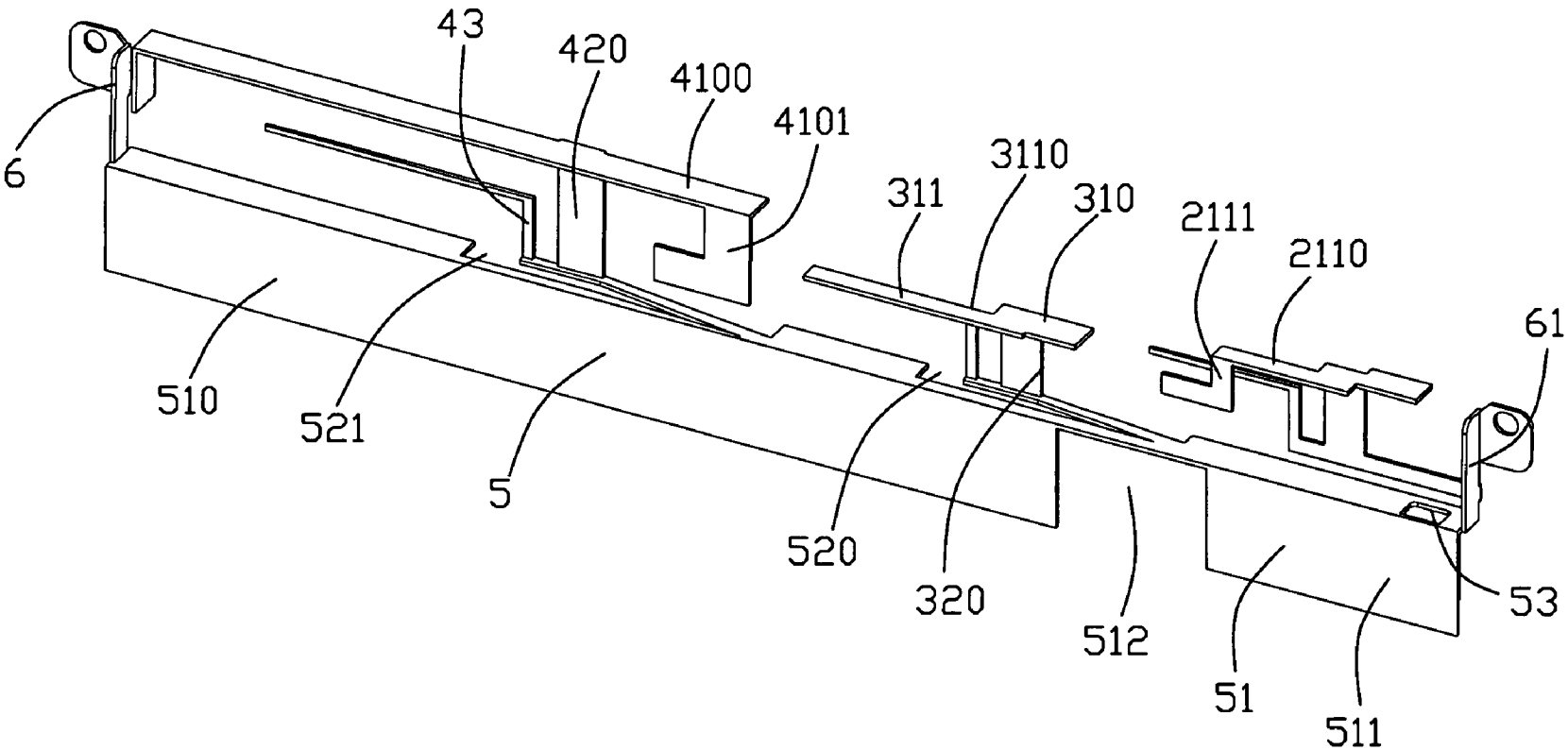
FIG. 2 is a perspective view of FIG. 1, but viewed from another angle.

Reference to FIG. 1 and FIG. 2, a multi-band antenna in according with a first embodiment of the present invention is shown. The multi-band antenna 10 is made by incising an integrated metal patch, and comprises a first antenna 2, a second antenna 3, a third antenna 4, a grounding element 5, a pair of setting elements 6, and three feeding lines (not shown).

The grounding element 5 comprises a horizontal grounding portion 52 and a vertical grounding portion 51 perpendicular to the horizontal grounding portion 52. The vertical grounding portion 51 comprises a first grounding patch 510 and a second grounding patch 511 shorter than the first grounding patch 510. The second grounding patch 511 is separated from the first grounding patch 510 to form a rectangular gap 512. Two cutout 520, 521 are formed on the second grounding patch 52. An aperture 53 is formed on one terminal portion of the grounding element 53 to provide a passage for the three feeding lines.

The two setting elements 6 upward extends from the two opposite ends of the grounding element 5, and the multi-band antenna 10 is fixed on an electric device through the setting elements 6.

The first antenna 2 extends from one of the setting elements 6. The second antenna 3 and the third antenna 4 respectively extends from the edge of two cutout 520, 521 of the grounding element 5. The three antennas 2, 3, 4 substantially extends along a horizontal lengthwise direction, and the second antenna 3 is between the first antenna 2 and the third antenna 4.

The first antenna 2 comprises a horizontal first connecting portion 22 connected to the setting elements 6 and a first radiating element (not signed). The first radiating element comprises a first L-shape radiating portion 23 extending from the end of the first connecting portion 22, a vertical first conductive portion 220 upward extending from the first connecting portion 22 and separated from the first L-shape radiating portion 23, a second conductive portion 211 extending from the first conductive portion 220 in a horizontal first direction, and a third conductive portion 210 extending from the second conductive portion 211 in a second direction opposite to the first direction. The first conductive portion 220 and the first L-shape radiating portion 23 are located on a same plane. The second conductive portion 211 comprises a horizontal L-shape arm 2110 and a vertical L-shape arm 2111 downward extending from the end of the first arm 2110. The third conductive portion 210 is of rectangular shape. A first feeding point Q1, which the electrical current is fed into the first antenna through, is formed on the end of the first connecting portion 22. Thus, electrical current goes through the first conductive portion 220 and the second conductive portion 211 to resonate a first frequency band on 2.3-2.7 GHz. The electrical current transits along the first conductive portion 220 and the third conductive portion 210 to resonate a second frequency band on 4.9-5.9 GHz. The first L-shape radiating portion 23 works on 3.3-3.8 GHz.

The second antenna 3 comprises a second connecting portion 32 extending from the grounding element 5 and received in the cutout 520, a second L-shape radiating portion 311 extending from the end of the second connecting portion 32, a vertical first section 320 extending from the second connecting portion 32 and separated from the second L-shape radiating portion 311, a horizontal second section 310 extending from the first section 320 in the second direction and perpendicular to the first section 320, and a horizontal third section 311 extending from the second section 310 in the first direction. A second feeding point Q2, which the electrical current is fed into the second antenna through, is formed on the end of the second connecting portion 32. Thus, the electrical current flow through the first L-shape radiating portion 311 to resonant a frequency band on 3.3-3.8 GHz. The electrical current passes through the first section 310 and the second section 320 to resonate a frequency band on 4.9-5.5 GHz; passes through the first section 310, the second section 320 and the third section 311 to resonate a frequency band on 2.3-2.7 GHz.

The third antenna 4 comprises a third connecting portion 42 extending from the grounding element 5 and received in the cutout 521, a third L-shape radiating portion 43 extending from the end of the third connecting portion 521, a vertical first conductive piece 420 extending from the third connecting portion 521 and separated form the third L-shape radiating portion 43, a horizontal second conductive piece 410 extending from the first conductive piece 420 in the second direction, and a third conductive piece 411 extending from the first conductive piece 420 in the first direction. The second conductive piece 410 comprises a horizontal and rectangular first sheet 4100 extending form the first conductive piece 420 and a vertical L-shape second sheet 4101 downward extending from the first sheet 4100. The third conductive piece 411 is of tridimensional L shape, and comprises a gadarene terminal 4110 on the end thereof. The third L-shape radiating portion 43 is used to resonant a frequency band on 1.7-2.2 GHz. Both of the second conductive piece and the third conductive piece work on a frequency band on 824-960 MHz.

Figure 3:
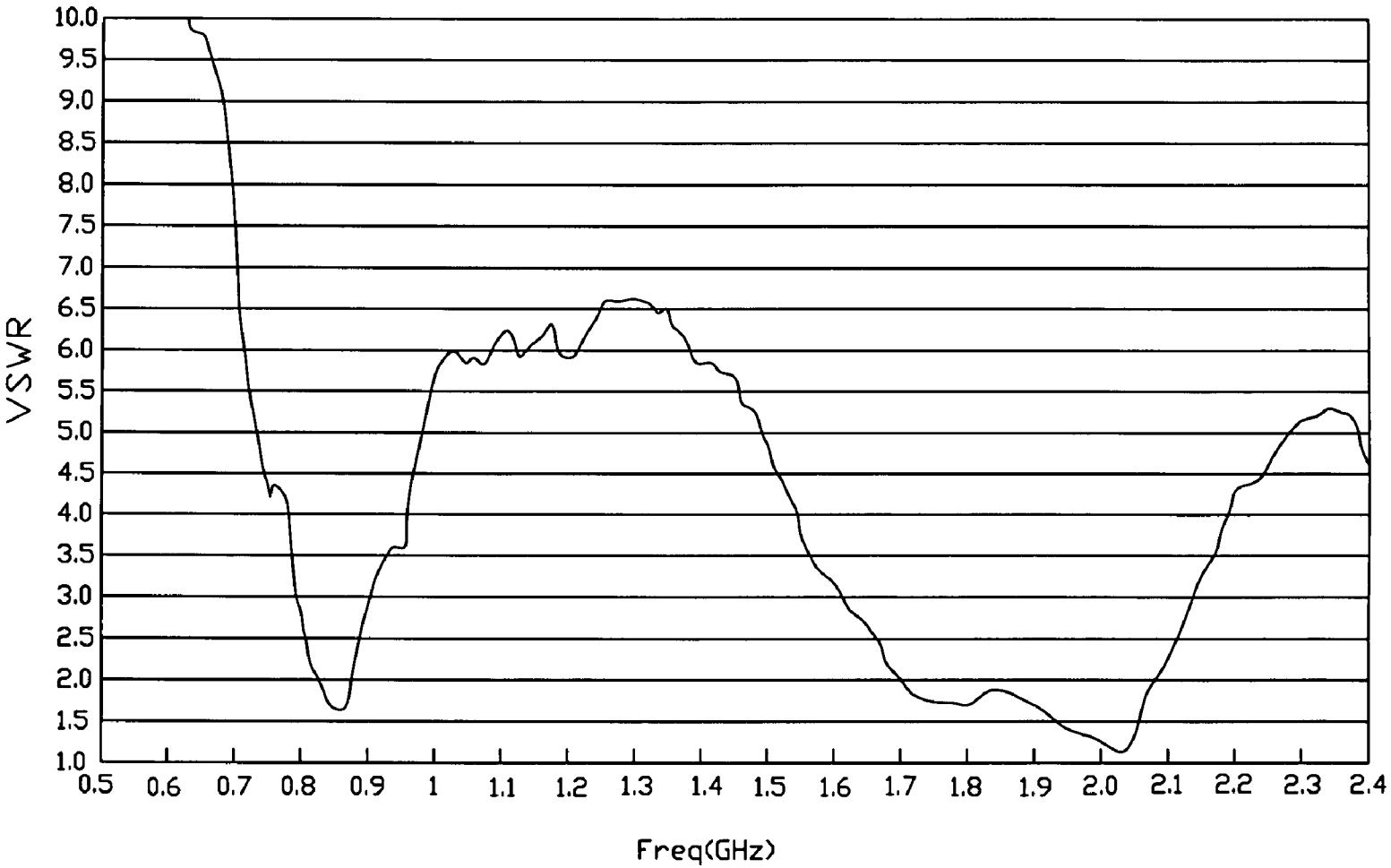
FIG. 3 is a test chart recording for the third antenna of the multi-band antenna of FIG. 1, showing Voltage Standing Wave Ratio (VSWR) as a function of WLAN frequency.
Figure 4:
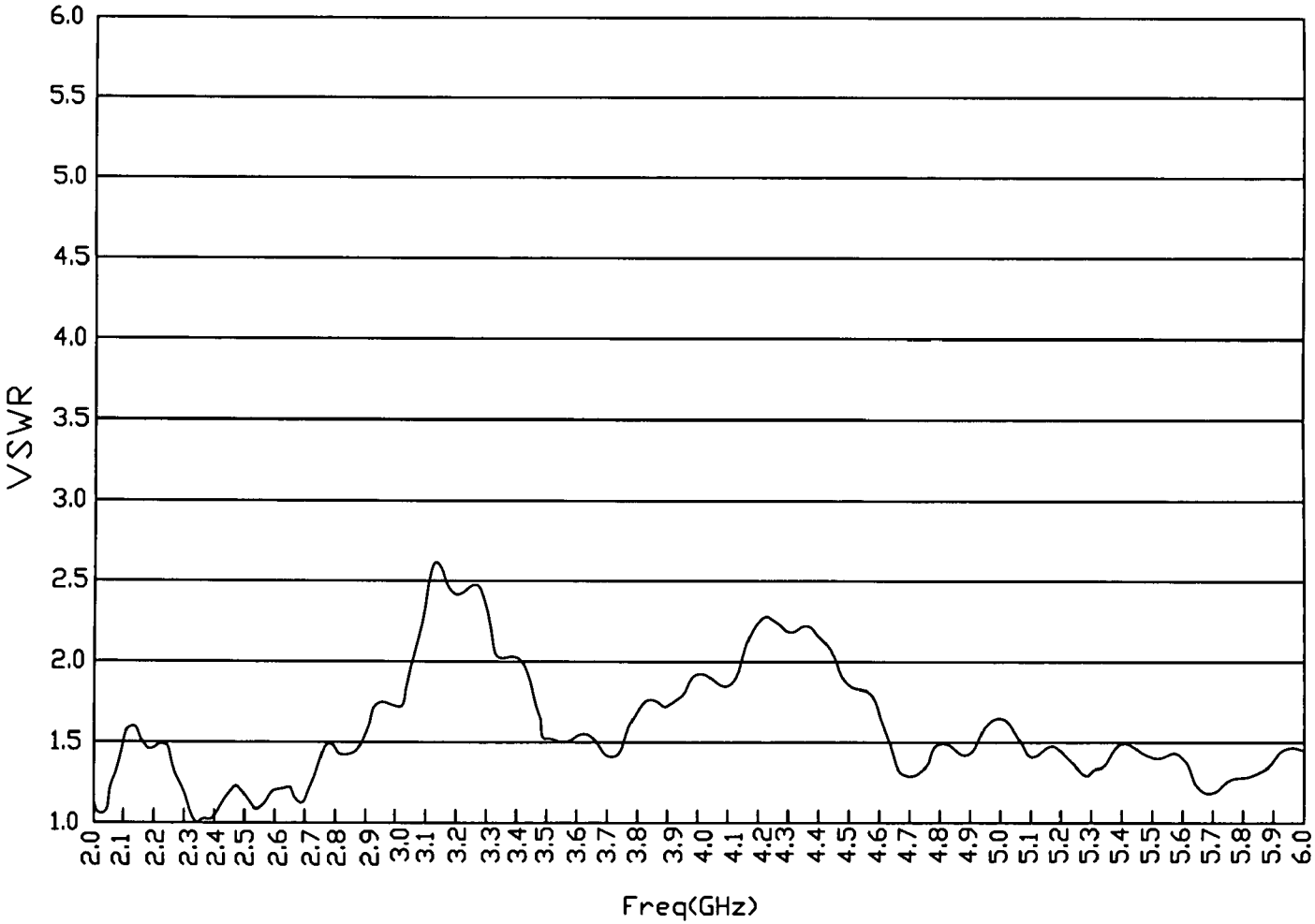
FIG. 4 is a test chart recording for the second antenna of the multi-band antenna of FIG. 1, showing Voltage Standing Wave Ratio (VSWR) as a function of WLAN frequency.
Figure 5:
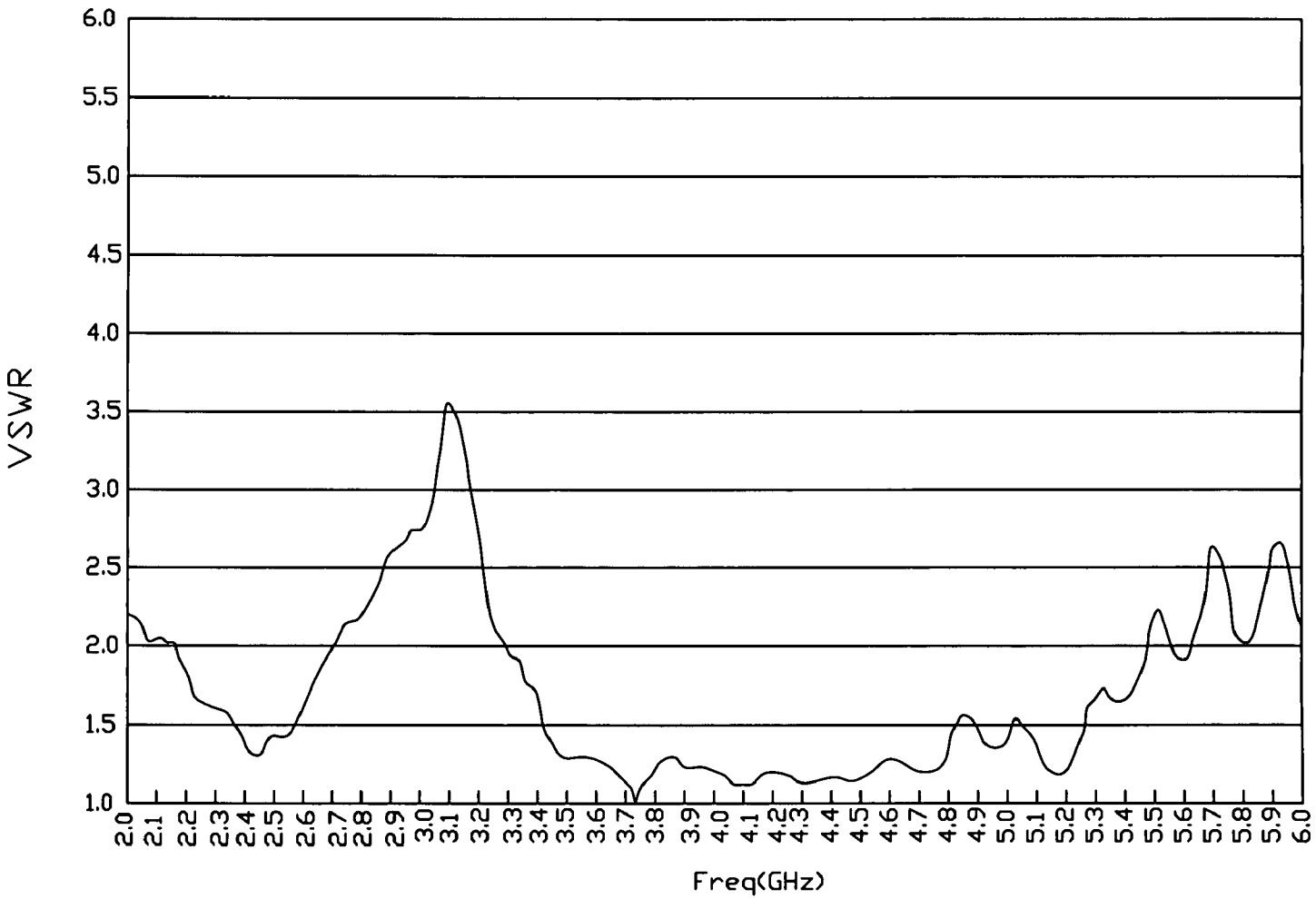
FIG. 5 is a test chart recording for the first antenna of the multi-band antenna of FIG. 1, showing Voltage Standing Wave Ratio (VSWR) as a function of WLAN frequency.

Reference to FIGS. 3-5, test chars of the third, second, and first antenna 4, 3, 2 are respectively shown. Obviously, the multi-band antenna 10 is fit to work under three different wireless communication criterions which are respectively WiMAX (Worldwide Interoperability for Microwave Access), WLAN (Wireless Local Are Net), and WWAN (Wireless Wide Area Net).

What is claimed is:

1. A multi-band antenna, being made from an integrated metal patch, comprising:

a grounding element;

a first antenna and a second antenna, both of which work in wireless local area net; and a third antenna, working in wireless wide area net; wherein said first, second, and third antennas extend from the grounding element, substantially along a lengthwise direction, and are separated from each other.

2. The multi-band antenna as claimed in claim 1, further comprises two setting elements upward extending from the two opposite ends of the grounding element.

3. The multi-band antenna as claimed in claim 2, wherein said grounding element comprises two cutouts separated from each other.

4. The multi-band antenna as claimed in claim 3, wherein said first antenna extends from one of the setting elements, said second antenna and said third antenna respectively extends from the edge of two cutout of the grounding element, and said second antenna is between the first antenna and the third antenna.

5. The multi-band antenna as claimed in claim 4, wherein said second antenna comprises a second connecting portion extending from the grounding element and received in the first cutouts, a second L-shape radiating portion extending from the end of the second connecting portion, a vertical first section extending from the second connecting portion and separated from the second L-shape radiating portion, a horizontal second section extending from the first section in the second direction and perpendicular to the first section, and a horizontal third section extending from the second section in the first direction.

6. The multi-band antenna as claimed in claim 5, wherein said second connecting portion further comprises a second feeding point on the end thereof.

7. The multi-band antenna as claimed in claim 5, wherein said first L-shape radiating portion is used to resonant a frequency band on 3.3-3.8 GHz, said second section is used to resonate a frequency band on 4.9-5.5 GHz, said third section is used to resonate a frequency band on 2.3-2.7 GHz.

8. The multi-band antenna as claimed in claim 3, wherein said third antenna comprises a third connecting portion extending from the grounding element and received in the second cutout, a third L-shape radiating portion extending from the end of the third connecting portion, a vertical first conductive piece extending from the third connecting portion and separated form the third L-shape radiating portion, a horizontal second conductive piece extending from the first conductive piece in the second direction, and a third conductive piece extending from the first conductive piece in the first direction.

9. The multi-band antenna as claimed in claim 8, wherein said second conductive piece comprises a horizontal and rectangular first sheet extending form the first conductive piece and a vertical L-shape second sheet downward extending from the first sheet.

10. The multi-band antenna as claimed in claim 8, wherein said third conductive piece is of tridimensional L shape, and comprises a gadarene terminal on the end thereof.

11. The multi-band antenna as claimed in claim 8, wherein said third L-shape radiating portion is used to resonant a frequency band on 1.7-2.2 GHz, Both of said second conductive piece and third conductive piece work on a frequency band on 824-960 MHz.

12. The multi-band antenna as claimed in claim 2, wherein said first antenna comprises a horizontal first connecting portion connected to the setting elements, a first L-shape radiating portion extending from the end of the first connecting portion, a vertical first conductive portion upward extending from the first connecting portion and separated from the first L-shape radiating portion, a second conductive portion extending from the first conductive portion in a horizontal first direction, and a third conductive portion extending from the second conductive portion in a second direction opposite to the first direction.

13. The multi-band antenna as claimed in claim 12, wherein said first conductive portion and said first L-shape radiating portion are located on a same plane, said second conductive portion comprises a horizontal L-shape arm and a vertical L-shape arm downward extending from the end of the first arm, said third conductive portion is of rectangular shape.

14. The multi-band antenna as claimed in claim 12, wherein said first connecting portion comprises a first feeding point on the end thereof.

15. The multi-band antenna as claimed in claim 12, wherein said second conductive portion is used to resonate a first frequency band on 2.3-2.7 GHz, said third conductive portion is used to resonate a second frequency band on 4.9-5.9 GHz, said first L-shape radiating portion works on 3.3-3.8 GHz.

16. A multi-band antenna comprising:

a ground element including a vertical grounding section and a horizontal grounding section;

first and second antennas respectively extending from two spaced first and second cutouts formed in the horizontal grounding section, the first antenna defining a first connection portion extending in the first cutout and being coplanar with the horizontal grounding section, and a first radiating portion extending parallel to the horizontal grounding section;

the second antenna defining a second connection portion extending in said second cutout and being coplanar with the horizontal grounding section, and a second radiating portion extending parallel to the horizontal grounding section.

17. The multi-band antenna as claimed in claim 16, wherein both said first connection portion and said second connection portion extend obliquely with regard to the vertical grounding section.

18. The multi-band antenna as claimed in claim 16, wherein each of said first connection portion and said second connection portion is linked, at an end, to an L-shaped radiation portion.

19. The multi-band antenna as claimed in claim 16, further including a third antenna cooperating with the first and second antennas so as to perform all three WiMAX, WLAN and WWAN, respectively.

20. A multi-band antenna, being made from an integrated metal patch, comprising:

a grounding element;

a first antenna and a second antenna, both of which work in wireless local area net; and a third antenna, working in wireless wide area net;

said first, second, and third antennas extending from the grounding element and substantially along a lengthwise direction;

further comprises two setting elements upward extending from the two opposite ends of the grounding element; wherein said grounding element comprises two cutouts separated from each other.

* * * * *